US005671616A

United States Patent [19]

Choe

[11] Patent Number: 5,671,616

[45] Date of Patent: Sep. 30, 1997

[54] RESONATOR OF A LOW FREQUENCY OSCILLATION WASHING MACHINE

[75] Inventor: Gyu Sang Choe, Kyungki-do, Rep. of Korea

[73] Assignee: LG Electronics Inc., Seoul, Rep. of Korea

[21] Appl. No.: 580,597

[22] Filed: Dec. 29, 1995

[30] Foreign Application Priority Data

Jul. 3, 1995 [KR] Rep. of Korea ..... 19270/1995

[51] Int. Cl.[6] ..... D06F 23/04; D06F 37/12

[52] U.S. Cl. ..... 68/23 R; 68/148; 68/156; 68/171

[58] Field of Search ..... 68/23 R, 23.3, 68/148, 152, 153, 154, 156, 171, 172, 174

[56] References Cited

U.S. PATENT DOCUMENTS 1,688,555 10/1928 Rankin ..... 68/23 R 3,740,975 6/1973 Cornelius ..... 68/23.3 X 4,202,187 5/1980 Hukuzawa et al. ..... 68/23 R X 4,771,615 9/1988 Fukuzawa et al. ..... 68/23 R

FOREIGN PATENT DOCUMENTS 89198 10/1986 Japan ..... 68/23 R

*Primary Examiner*—Philip R. Coe

*Attorney, Agent, or Firm*—Fish & Richardson P.C.

[57] ABSTRACT

A resonator of a low frequency oscillation washing machine mounted to an outer periphery of a washtub has an outer periphery shaped so that a distance between the rotational center of the washtub and the outer periphery of the resonator gradually varies between points on the outer periphery of the resonator. At least one discharging hole is provided in a portion of the outer periphery of the resonator which is the farthest from the rotational center of the washtub within the varying portion.

3 Claims, 3 Drawing Sheets

RESONATOR OF A LOW FREQUENCY OSCILLATION WASHING MACHINE

BACKGROUND OF THE INVENTION

1. Field of the Invention

The invention relates to a resonator of a low frequency oscillation washing machine that performs a washing or cleaning stroke by oscillating a multiform medium consisting of water, detergent and air layers at a specific frequency. In particular, the invention relates to a resonator for promoting resonating phenomena within a washtub and externally discharging water after performing a drying operation.

2. Description of the Prior Art

Generally, a low frequency oscillation washing machine uses an oscillator to bring about resonating phenomena in a multiform medium consisting of water, detergent and air layers within a washtub. Washing and cleaning operations result from mechanical energy caused by cavitation phenomena or non-linear oscillation of air bubbles within the multiform medium and from chemical energy of the detergent.

FIG. 1 is a vertical section view of a conventional low frequency oscillation washing machine. Here, a washtub 1 retains the multiform medium consisting of the water, detergent and air layers. An oscillator 2 is installed in an inner lower portion of washtub 1, and an outer tub 3 is positioned around washtub 1.

A crank mechanism 4 is connected to a lower portion of outer tub 3 for either changing a rotational motion into a reciprocating motion or directly transferring the rotational motion. A pulley 5 is fixed to a lower end of a crank mechanism 4. Motive power of a motor 6 fixed to a lower portion of outer tub 3 is transferred to crank mechanism 4 via a belt 7 and pulley 5. A rotational motion shaft 9 coupled with a reciprocating motion shaft 8 therein is installed to an upper end of crank mechanism 4. Reciprocating motion shaft 8 is connected to be fixed with oscillator 2, and rotational motion shaft 9 is connected to be fixed with washtub 1.

As shown in FIG. 2, a resonator 10 is attached to an outer side of washtub 1. A distance r from a rotational center of washtub 1 to an outer periphery of resonator 10 is constant along the entire perimeter of resonator 10. Discharging holes 10*a* that permit water to escape from the laundry during a drying stroke are formed in the outer periphery of resonator 10.

Operation of the washing machine is described below. First, the laundry is put in washtub 1 and water is supplied up to a predetermined level. Thereafter motor 6 is activated to rotate in a first direction under and the motive power of motor 6 is transmitted to pulley 5 of crank mechanism part 4 via belt 7. At this time, the rotational force of crank mechanism 4 is converted to a reciprocating motion that is transferred by reciprocating motion shaft 8 to oscillator 2.

Oscillator 2 oscillates by a specific frequency resulting from the rotational speed of motor 6, and induces a resonating phenomena in the multiform medium consisting of the water, detergent and air layers. At this time, the resonating phenomena is also induced in resonator 10. As a result, the mechanical energy of the cavitation phenomena of the air bubbles generated by the resonating phenomena, the vibration of water and the like performs the washing and cleaning functions.

After the washing and cleaning stroke is finished, motor 6 is rotated in a second direction that is the reverse of the first direction to perform drying. When motor 6 is rotated in the reverse direction, the rotational motion transmitted to pulley 5 via belt 7 is transferred solely to rotational motion shaft 9 of crank mechanism part 4. Thus, rotational motion shaft 9 rotates washtub 1 to proceed the drying stroke. At this time, reciprocating motion shaft 8 within rotational motion shaft 9 does not perform the reciprocating motion but executes the rotational motion together with rotational motion shaft 9.

When washtub 1 performs the rotational motion as described above, the water (washing water) permeating the laundry is wrung from the laundry by a centrifugal force of washtub 1. The water wrung from the laundry is expelled via discharging holes 10*a* to be exhausted via a drainpipe (not shown) installed to a lower portion of outer tub 3. The drying stroke is completed when the water is exhausted via the drainpipe.

In the conventional low frequency oscillation washing machine, however, multiple discharging holes 10*a* are formed in the outer side of resonator 10 as shown in FIG. 2A to improving the drying performance. Consequently, the oscillating force is not sufficiently applied to the multiform medium in washtub 1 in the horizontal direction of washtub 1. In other words, since the oscillating force goes out toward outer tub 3, the oscillating force is not sufficiently transferred to the multiform medium within washtub 1.

To solve the above; described problem, fewer discharging holes 10*a* are formed in resonator 10 as shown in FIG. 2B. This presents the decrease in the horizontal oscillating force, but results in some water remaining within resonator 10 and both being exhausted via discharging holes 10*a*.

The reason of blocking the exhaust of the water via discharging holes 10*a* is as follows. A distance r from the rotational center of washtub 1 to the outer periphery of resonator 10 is the same regardless of the circumferential direction. Thus, the water within resonator 10 is applied with the force in the direction of a tangent line (perpendicular to a semi-radius direction) when washtub 1 is rotated. Therefore, the water within resonator 10 remaining in the portion without discharging holes 10*a* is not exhausted via discharging holes 10*a* to be again admitted into washtub 1 or deteriorated within resonator 10.

SUMMARY OF THE INVENTION

The invention is devised to solve the above-described problems. Accordingly, it is an object of the invention to provide a resonator for a low frequency oscillation washing machine, where the resonator includes an improved structure that enhances dehydration efficiency during a drying stroke without decreasing the oscillation transmitting force to the multiform medium during washing.

To achieve the above object of the invention, a resonator of a low frequency oscillation washing machine is mounted to an outer periphery of a washtub. A distance from a rotational center of the washtub to an outer periphery of the resonator gradually varies between points on the outer periphery of the resonator, and at least one discharging hole is provided in a portion which is the farthest from the rotational center of the washtub within the varying portion.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Embodiments of a resonator of a low frequency oscillation washing machine according to the invention will be described with reference to FIGS. 3 and 4.

Figure 1:
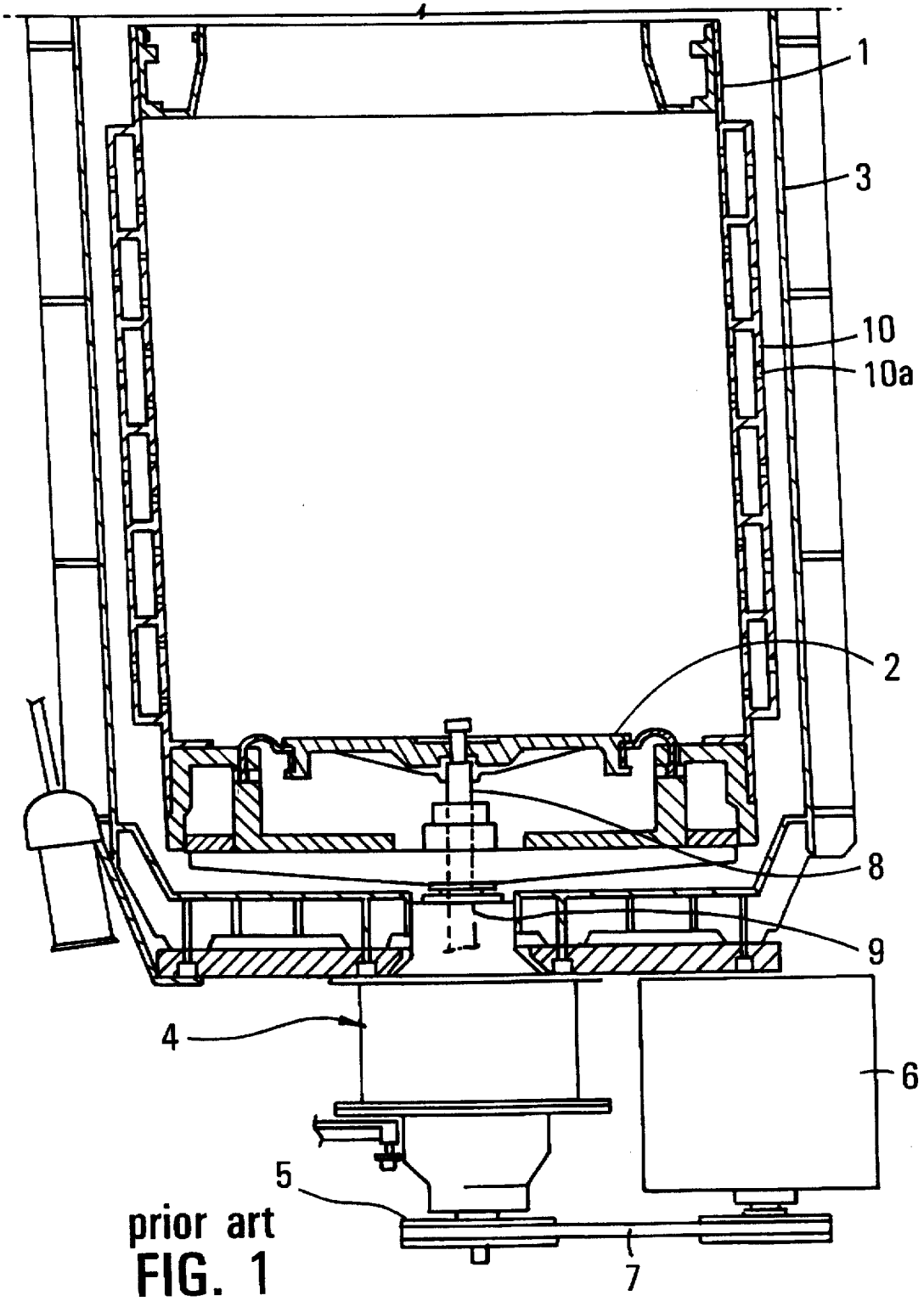
prior art FIG. 1
FIG. 1 is a vertical section view showing a conventional low frequency oscillation washing machine.
Figure 2A:
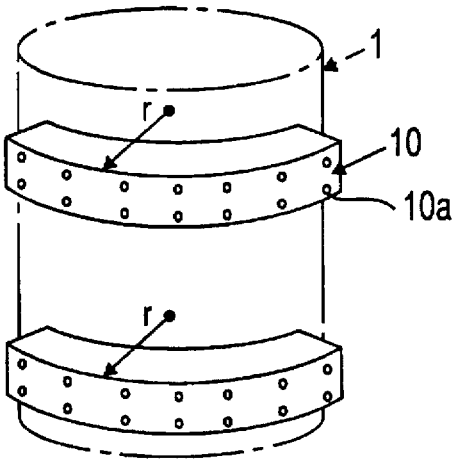
FIG.2A prior art
FIGS. 2A and 2B are perspective views showing conventional resonators.
Figure 2B:
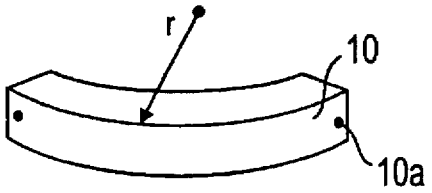
FIG.2B prior art
Figure 3:
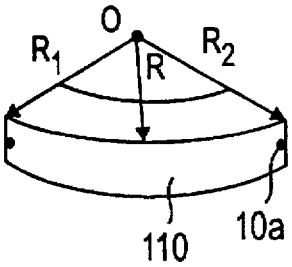
FIGS. 3 and 4 are perspective views showing embodiments of resonators according to the invention.

FIG. 3 illustrates a first embodiment of the invention. Here, a distance R from a rotation center O of a washtub 1 to an outer periphery of the resonator 110 is gradually elongated as reaching from one point of the outer periphery (indicated by R) to both sides thereof (indicated by $R_1$ and $R_2$), where $R_1>R$ and $R_2>R$. Discharging holes 10*a* are formed in both ends of the gradually enlarged portion.

Figure 4:
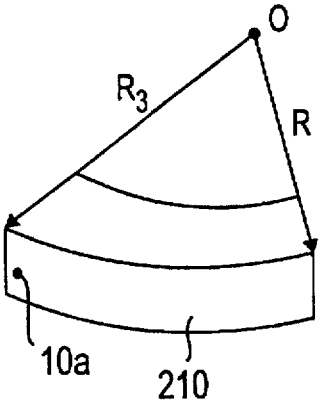

FIG. 4 illustrates a second embodiment of the present invention. Here, a distance R from a rotation center O of a washtub 1 to the outer periphery of a resonator 210 is gradually elongated from one end of the outer periphery (indicated by R) to the other end of the outer periphery (indicated by $R_3$), where $R_3>R$, and a discharging hole 10*a* is formed in the end of the gradually enlarged portion.

An operation and effect of the above embodiments constructed as above will be described below.

Like the conventional low frequency oscillation washing machine, once the laundry is put in washtub 1 and a motor 6 is rotated, the rotational motion of motor 6 is converted into a reciprocating motion of an oscillator 2 to perform a washing stroke. In the reciprocating mode, the described embodiments operate like a conventional low frequency oscillation washing machine.

Thereafter, the rotational direction of motor 6 is reversed to transfer the rotational motion of motor 6 to rotational motion shaft 9 via a crank mechanism 4, and to start rotation of washtub 1. When washtub 1 rotates, water permeating the laundry within washtub 1 is expelled via resonator 10.

Figure 5:
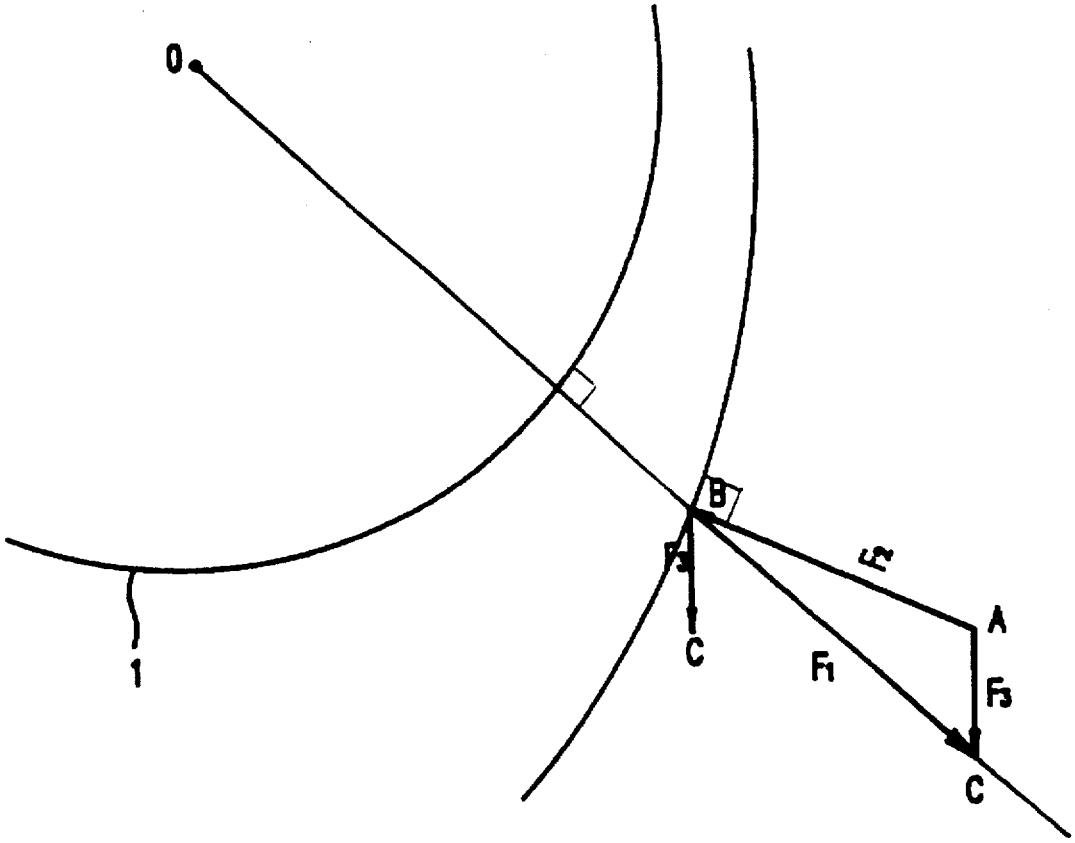
FIG. 5 illustrates a principle of the resonator according to the invention as a vector of a force.

As shown in FIG. 5, when performing the above-described drying stroke, the water admitted into resonator 10 is affected by a centrifugal force $F_1$ resulting from the rotational motion of washtub 1. Centrifugal force $F_1$ exerted along a straight line extending from the rotational center O. However, a vertical vector $F_2$ of an inner surface of the outer side of resonator 10 does not face toward rotation center O of washtub 1. This is because distance R from rotation center O of washtub 1 to the outer periphery of resonator 10 is gradually elongated as reaching from any one point of resonator 10 to one side or both sides thereof. Consequently, the water bubbles attached on the inner surface of resonator 10 are subjected to a force $F_3$ in the direction slanted from vertical vector $F_2$ at the inner surface of the outer side of resonator 10. Briefly, the water bubbles within resonator 10 are moved toward a portion having longer distance R between two points, thereby quickly being exhausted via discharging hole 10*a*.

In the low frequency oscillation washing machine according to the invention as described above, the distance of the outer periphery of the resonator from the rotational center of the washtub is gradually increased, and at least one discharging hole is formed in the outer portion of the periphery of the resonator, that is the farthest from the rotation center of the washtub. As a result, the oscillating force transferred to the multiform medium is prevented from being lowered during the washing stroke while the water bubbles do not remain within the resonator after completing the hydrating stroke.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A resonator of a low frequency oscillation washing machine configured to be mounted to an outside surface of a washtub, comprising:

an outer peripheral surface, and a discharging hole formed in the outer peripheral surface, wherein a distance from a rotational center of said washtub to the outer peripheral surface of said resonator varies gradually along the outer peripheral surface, and wherein the discharging hole is located in a portion of the outer peripheral surface that is farthest from said rotational center of said washtub.

2. The resonator of claim 1, wherein a distance from said rotational center of said washtub to said outer peripheral surface of said resonator increases gradually from a central portion of the outer peripheral surface toward two end portions of the outer peripheral surface and a discharging hole is provided in each end portion.

3. The resonator of claim 1, wherein a distance from said rotational center of said washtub to said outer peripheral surface of said resonator increases gradually from a first end portion of the outer peripheral surface toward a second end portion of the outer peripheral surface and said discharging hole is provided in the end portion that is farthest from the rotational center.

* * * * *